US007413421B2

(12) United States Patent
Ichikawa

(10) Patent No.: US 7,413,421 B2
(45) Date of Patent: Aug. 19, 2008

(54) MULTI-CYLINDER RECIPROCATING COMPRESSOR

(75) Inventor: Yoshinobu Ichikawa, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 719 days.

(21) Appl. No.: 10/932,229

(22) Filed: Sep. 2, 2004

(65) Prior Publication Data

US 2005/0053505 A1 Mar. 10, 2005

(30) Foreign Application Priority Data

Sep. 10, 2003 (JP) ..... 2003-317977

(51) Int. Cl.
*F04B 27/12* (2006.01)
*F16K 15/14* (2006.01)

(52) U.S. Cl. ..... 417/571; 417/569; 417/269; 137/855; 137/856

(58) Field of Classification Search ..... 417/269, 417/569, 571; 91/499
See application file for complete search history.

(56) References Cited

U.S. PATENT DOCUMENTS 4,642,037 A * 2/1987 Fritchman ..... 417/571
5,647,395 A * 7/1997 Hashimoto et al. ..... 137/517
5,885,064 A * 3/1999 McCoy ..... 417/569
6,767,193 B2 * 7/2004 Hirose et al. ..... 417/269
7,232,294 B2 * 6/2007 Shimizu et al. ..... 137/856

FOREIGN PATENT DOCUMENTS

| | | |
|---|---|---|
| JP | 625576 | 8/1994 |
| JP | 09-280168 | * 10/1997 |
| JP | 2003-3084208 | * 12/2002 |

* cited by examiner

*Primary Examiner*—Devon Kramer
*Assistant Examiner*—Patrick Hamo
(74) *Attorney, Agent, or Firm*—Baker Botts L.L.P.

(57) ABSTRACT

A multi-cylinder reciprocating compressor has a plurality of compression chambers and a plurality of discharge valve devices associated with the respective compression chambers. Each discharge valve device includes a valve reed for opening and closing a corresponding discharge hole formed through a valve plate, and a retainer for regulating the lift of the valve reed. The retainer includes a stopper surface inclined with respect to the valve plate as viewed in cross section of the retainer, and the stopper surface has one side edge and the other side edge located remoter from the valve plate than the one side edge. The discharge hole is positioned such that the center of gravity of the cross section thereof is shifted from the center of the valve reed in the width direction thereof toward the other side edge of the stopper surface.

19 Claims, 10 Drawing Sheets

MULTI-CYLINDER RECIPROCATING COMPRESSOR

This nonprovisional application claims priority under 35 U.S.C. 119(a) on Patent Application No. 2003-317977 filed in Japan on Sep. 10, 2003, the entire contents of which are incorporated herein by reference.

BACKGROUND OF THE INVENTION

1. Field of the Invention

The present invention relates to a multi-cylinder reciprocating compressor, and more particularly, to a multi-cylinder reciprocating compressor suitable for use in a refrigeration circuit of an automotive air conditioning system.

2. Description of the Related Art

This type of multi-cylinder reciprocating compressor is disclosed, for example, in Japanese Utility Model Publication No. H06-25576. The compressor disclosed in this publication has a plurality of compression chambers, a discharge chamber, and discharge valves associated with the respective compression chambers to allow refrigerant compressed in the respective compression chambers to be discharged into the discharge chamber.

More specifically, each discharge valve has a valve reed attached to a valve plate located between the compression chambers and the discharge chamber. The valve reed opens and closes a discharge hole formed through the valve plate. The discharge valve further includes a retainer for regulating the opening of the valve reed, and the retainer has a stopper surface facing the valve plate.

When the pressure of the refrigerant in the compression chamber surpasses the valve closing force of the valve reed, the refrigerant causes the free end of the valve reed to lift from the valve plate toward the retainer. As a result, the discharge hole opens, allowing the refrigerant in the compression chamber to be discharged into the discharge chamber through the discharge hole. When the refrigerant is discharged in this manner, the valve reed abuts against the stopper surface of the retainer. Thus, the stopper surface serves to regulate the lift of the free end of the valve reed, that is, the opening of the valve reed.

The stopper surface of the retainer is inclined with respect to the valve plate, as viewed in cross section of the valve reed. Accordingly, when the valve reed is lifted, the valve reed comes into close contact with the stopper surface while being twisted about a longitudinal axis thereof, so that the lift of the valve reed, that is, the distance between the free end of the valve reed and the valve plate, varies along the width direction of the valve reed. Specifically, the lift of the valve reed increases from one side edge thereof toward the other. Thus, the refrigerant discharged from the discharge hole flows mainly toward the other side edge of the valve reed, whereby directivity is imparted to the discharge of the refrigerant.

In the aforementioned discharge valve, therefore, stable opening/closing operation of the valve reed can presumably be ensured by directing the discharge direction of the refrigerant such that the refrigerant discharged from the discharge hole exerts no adverse influence on the opening/closing of the valve reeds of the adjacent discharge valves.

Since the valve reed has relatively high rigidity against twisting, however, the valve reed is insufficiently twisted when lifted, and it is difficult to bring the valve reed into satisfactorily close contact with the stopper surface of the retainer.

Consequently, the valve reed repeatedly strikes on the stopper surface when lifted, causing vibrations. Such vibrations not only produce unpleasant noise but impede smooth discharging of the refrigerant from the compression chamber, which lowers the compression efficiency of the compressor.

SUMMARY OF THE INVENTION

An object of the present invention is to provide a multi-cylinder reciprocating compressor wherein valve reeds of discharge valves can be reliably twisted when lifted, so as to come into satisfactorily close contact with inclined stopper surfaces of respective retainers, thereby ensuring stable opening/closing operation of the valve reeds.

To achieve the object, a multi-cylinder reciprocating compressor according to the present invention comprises: a cylinder block having a plurality of cylinder bores; pistons fitted into the respective cylinder bores and each forming one end wall of a compression chamber inside the corresponding cylinder bore; a driving device for reciprocating the pistons in the respective cylinder bores; and a valve mechanism for causing a suction process for sucking a working fluid into the compression chambers, a compression process for compressing the working fluid in the compression chambers and a discharge process for discharging the working fluid from the compression chambers to take place as the respective pistons reciprocate.

Specifically, the valve mechanism includes a valve plate arranged adjacent to the cylinder block and forming other end walls of the respective compression chambers, the valve plate having a plurality of suction holes disposed for communication with the respective compression chambers; a plurality of suction valves associated with the respective compression chambers and permitting the working fluid to be sucked into the respective compression chambers through the respective suction holes; and a plurality of discharge valve devices associated with the respective compression chambers and permitting the working fluid to be discharged from the respective compression chambers.

More specifically, each of the discharge valve devices includes a discharge hole formed through the valve plate in communication with the corresponding compression chamber; an elastically deformable valve reed for closing the discharge hole during the suction process, the valve reed being lifted from the valve plate during the discharge process to open the discharge hole; a retainer disposed on the valve plate with the valve reed therebetween for regulating the lift of the valve reed, the retainer including a stopper surface extending along the valve reed for resting the valve reed thereon when the valve reed is lifted, the stopper surface being inclined with respect to the valve plate, as viewed in cross section of the retainer, and having one side edge and the other side edge remoter from the valve plate than the one side edge; and assisting means for positively assisting the valve reed to be twisted in conformity with the inclination of the stopper surface when the valve reed is lifted.

In the compressor described above, when the valve reed is lifted, twisting of the valve reed is assisted so that the valve reed can come into satisfactorily close contact with the stopper surface of the retainer. Consequently, a sufficient lift of the valve reed is secured to permit the working fluid in the compression chamber to be smoothly discharged through the discharge hole, thereby preventing lowering of the compression efficiency of the compressor.

Also, the valve reed is prevented from repeatedly striking on the stopper surface of the retainer, thus suppressing unpleasant noise caused by vibrations of the valve reed.

Further, since the valve reed is inclined along the stopper surface when lifted, the working fluid discharged from the discharge hole flows in a direction primarily determined by the inclination of the valve reed. Accordingly, the discharge flow of the working fluid exerts no adverse influence on the valve reeds of the adjacent discharge valve devices, whereby the lifting of the valve reeds of the individual discharge valve devices can be stabilized.

The assisting means can be materialized by shifting the center of gravity of a cross section of the discharge hole from the center of the valve reed in a width direction thereof toward the other side edge of the stopper surface and/or shifting a twist axis of the valve reed from the center of gravity of the cross section of the discharge hole toward the one side edge of the stopper surface. With such arrangement, the flow of the working fluid discharged from the discharge hole positively applies twisting moment to the valve reed.

Specifically, to shift the twist axis of the valve reed, the valve reed may have a bay portion at a side edge thereof located close to the other side edge of the stopper surface, or may have a thickness decreasing from the one side edge of the stopper surface toward the other side edge of same.

Further, the assisting means may include a flexible portion which is located between a distal end and root of the valve reed and at which rigidity of the valve reed against twisting is decreased. The flexible portion may be a neck portion where the valve reed is reduced in width, a thin portion where the valve reed is reduced in thickness, or an opening for reducing a cross-sectional area of the valve reed.

Also, to materialize the assisting means, the discharge hole may have a circular or pear-shaped cross section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

Figure 1:
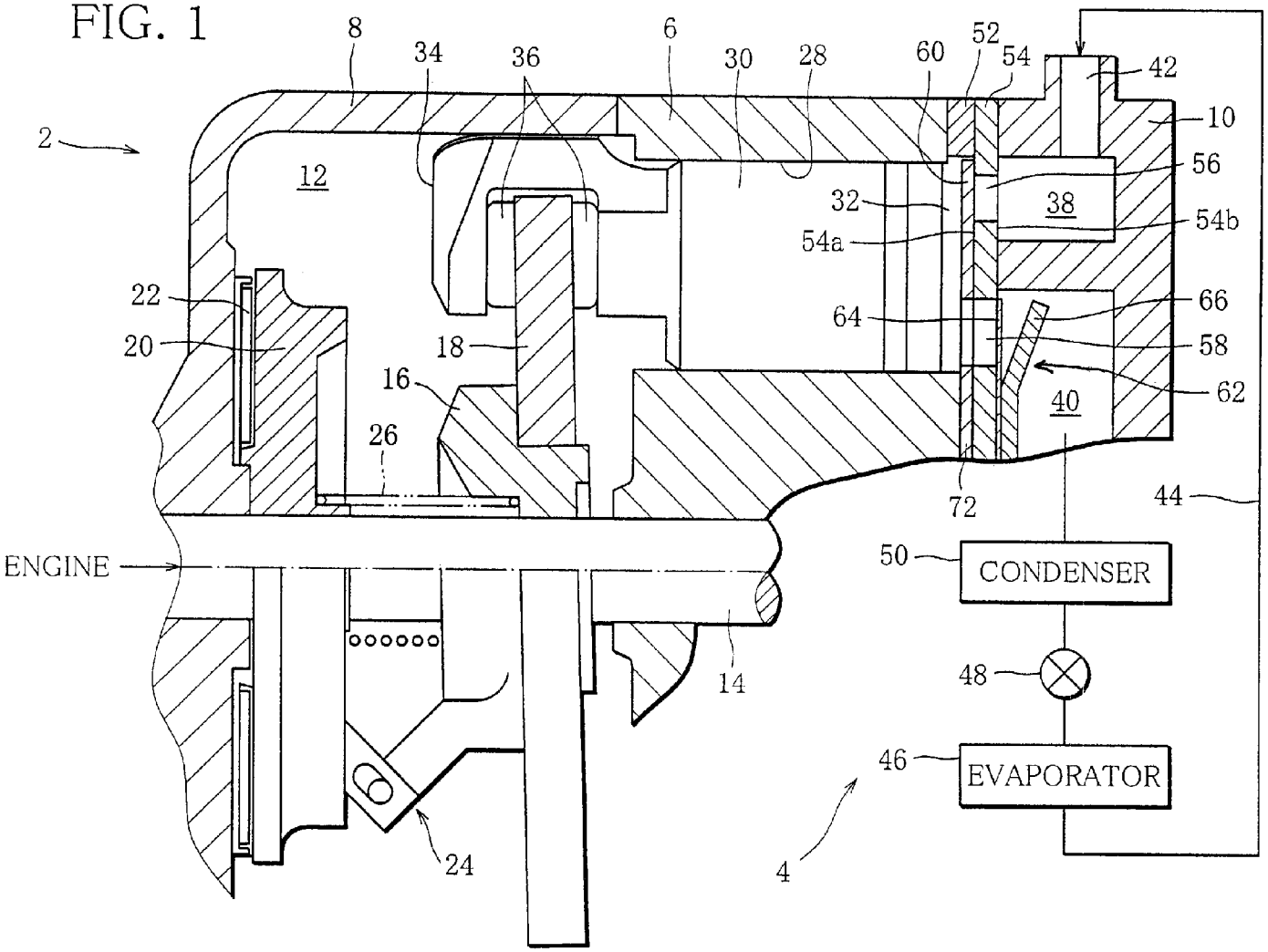
FIG. 1 is a longitudinal sectional view showing part of a multi-cylinder reciprocating compressor.

A swash plate compressor 2 shown in FIG. 1 is incorporated into a refrigeration circuit 4 of an air conditioning system for a motor vehicle. The compressor 2 has a cylinder block 6 of cylindrical form, and a front housing 8 and a cylinder head 10 are attached to respective opposite ends of the cylinder block 6. The front housing 8 defines a crank chamber 12 therein in cooperation with the cylinder block 6.

A drive shaft 14 is arranged in the crank chamber 12. The drive shaft 14 extends coaxially with the cylinder block 6 and is rotatably supported by both of the front housing 8 and the cylinder block 6 through respective bearings (not shown). One end of the drive shaft 14 projects from the front housing 8 and is connected to the engine of the vehicle through a power transmission path (not shown). Thus, the drive shaft 14 is rotated by the engine.

A swash plate 18 is mounted to the drive shaft 14 through a coupler 16, and the coupler 16, that is, the swash plate 18, is tiltable with respect to the drive shaft 14. Further, a rotor 20 is fitted on the drive shaft 14 for rotation together therewith. The rotor 20 is rotatably supported by an inner wall of the front housing 8 through a thrust bearing 22.

The rotor 20 is coupled to the coupler 16 through a link mechanism 24, and a compression coil spring 26 is interposed between the rotor 20 and the coupler 16. The link mechanism 24 transmits rotation of the rotor 20 to the coupler 16, that is, the swash plate 18. Accordingly, when the drive shaft 14 is rotated, the swash plate 18 rotates together with the drive shaft 14. Also, the link mechanism 24 permits the swash plate 18 to tilt relative to the drive shaft 14. The tilt angle of the swash plate 18 can be varied by the pressure in the crank chamber 12.

The cylinder block 6 has a plurality of cylinder bores 28 formed therein. The cylinder bores 28 are arranged at regular intervals in the circumferential direction of the cylinder block 6 and extend through the cylinder block 6. FIG. 1 shows only one cylinder bore 28.

A piston 30 is fitted into each cylinder bore 28 and defines a compression chamber 32 inside the cylinder bore 28. The piston 30 has a tail 34 projecting into the crank chamber 12 and retaining a pair of shoes 36. The shoes 36 slidably hold an outer peripheral edge of the swash plate 18 therebetween.

Accordingly, when the swash plate 18 is rotated, rotation thereof is converted to reciprocating motion of each piston 30. The reciprocating motion of the piston 30 causes a suction process in which a refrigerant is sucked into the compression chamber 32 and a compression/discharge process in which the refrigerant is compressed and discharged.

More specifically, the cylinder head 10 defines therein a suction chamber 38 and a discharge chamber 40, the suction chamber 38 being in the form of an annulus surrounding the discharge chamber 40. The suction chamber 38 is connected though a suction port 42 to a refrigerant line 44 of the refrigeration circuit 4, and the discharge chamber 40 is also connected to the refrigerant line 44 though a discharge port (not shown). The suction port 42 and the discharge port are formed in the cylinder head 10.

In the refrigerant line 44, an evaporator 46, an expansion valve 48, a condenser 50, etc. are arranged in this order as viewed from the side of the suction port 42.

An annular gasket 52 and a valve plate 54 are interposed between the cylinder block 6 and the cylinder head 10. The valve plate 54 separates the compression chambers 32 from the suction chamber 38 as well as from the discharge chamber 40 and has one surface 54*a* facing the cylinder block 6 and the other opposite surface 54*b* facing the cylinder head 10. The valve plate 54 has suction holes 56 and discharge holes 58 formed therein in association with the respective compression chambers 32, and the suction holes 56 are located outward of the discharge holes 58 in the radial direction of the valve plate 54. Namely, the suction holes 56 and the discharge holes 58 are located on respective circles with different diameters.

Suction valves 60 for opening and closing the respective suction holes 56 are attached to the valve plate 54. Each suction valve 60 comprises a reed valve and has a valve reed positioned on the one surface 54*a* of the valve plate 54. When the piston 30 is moved in the direction of increasing the volume of the compression chamber 32, the suction valve 60, that is, the valve reed thereof lifts from the valve plate 54 to open the suction hole 56, thereby allowing the refrigerant in the suction chamber 38 to be sucked into the compression chamber 32 through the suction hole 56.

Further, discharge valves 62 for opening and closing the respective discharge holes 58 are attached to the valve plate 54. Each discharge valve 62 includes a valve reed 64 positioned on the other surface 54*b* of the valve plate 54 and a retainer 66 for regulating the lift of the valve reed 64.

When the piston 30 is moved in the direction of decreasing the volume of the compression chamber 32, the refrigerant sucked into the compression chamber 32 is compressed by the piston 30. Subsequently, when the refrigerant pressure surpasses the valve closing force of the valve reed 64, the refrigerant in the compression chamber 32 elastically deforms the valve reed 64 to cause same to lift from the valve plate 54. As a result, the discharge hole 58 opens, so that the refrigerant in the compression chamber 32 is discharged into the discharge chamber 40 through the discharge hole 58. The lift of the valve reed 64, that is, the opening thereof is regulated by the retainer 66 against which the valve reed 64 is abutted or rested.

The refrigerant discharged into the discharge chamber 40 is then delivered to the refrigerant line 44 from the discharge port to pass through the condenser 50, the expansion valve 48 and the evaporator 46 and returns to the suction chamber 38 through the suction port 42. Thus, as the compressor 2 operates, the refrigerant circulates through the refrigeration circuit 4, whereby the interior of the vehicle can be air-conditioned by the refrigeration circuit 4.

Figure 2:
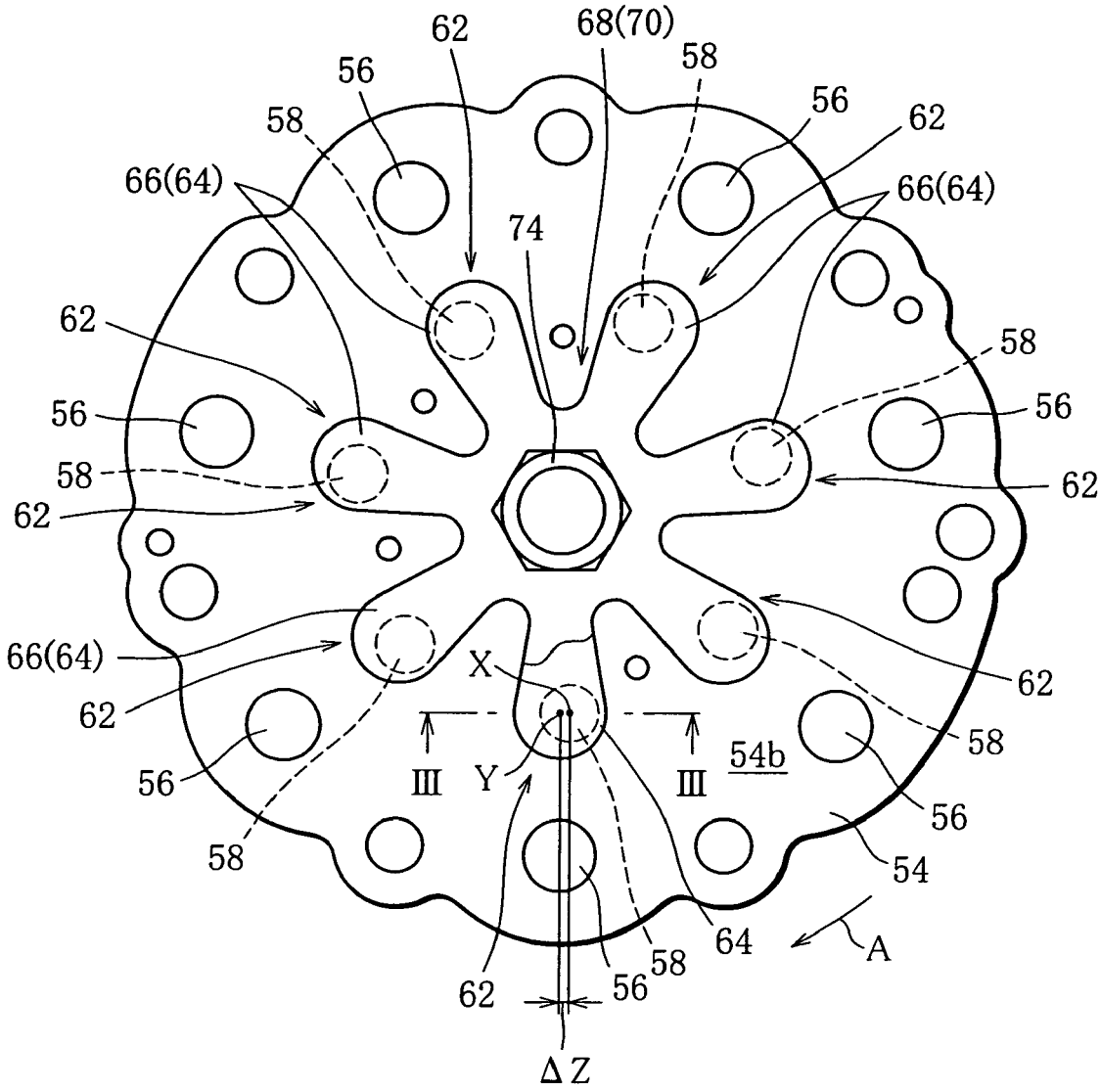
FIG. 2 is a rear view of discharge valve devices of a first embodiment incorporated into the compressor of FIG. 1.

FIG. 2 shows the discharge valves 62 as viewed from inside the discharge chamber 40. As is clear from FIG. 2, the retainer 66 of each discharge valve 62 is formed as a part of a star-shaped disc 68. Specifically, the star-shaped disc 68 has a plurality of radially extending fingers constituting the respective retainers 66. More specifically, as clearly shown in FIG. 1, each retainer 66 is inclined in a direction such that a distal end thereof is separated from the valve plate 54.

The valve reed 64 of each discharge valve 62 also is formed as a part of a star-shaped sheet 70 having an external form similar to that of the star-shaped disc 68. The star-shaped sheet 70 is flat, and therefore, the valve reeds 64 can closely contact with the other surface 54*b* of the valve plate 54.

Also, the valve reed of each suction valve 60 is formed as a part of a circular sheet 72 (see FIG. 1). The circular sheet 72 has slits segmenting the respective valve reeds and openings associated with the respective discharge holes 58.

The disc 68, the sheet 70, the valve plate 54 and the sheet 72 are fixed at their center to the cylinder block 6 by a bolt 74.

Figure 3:
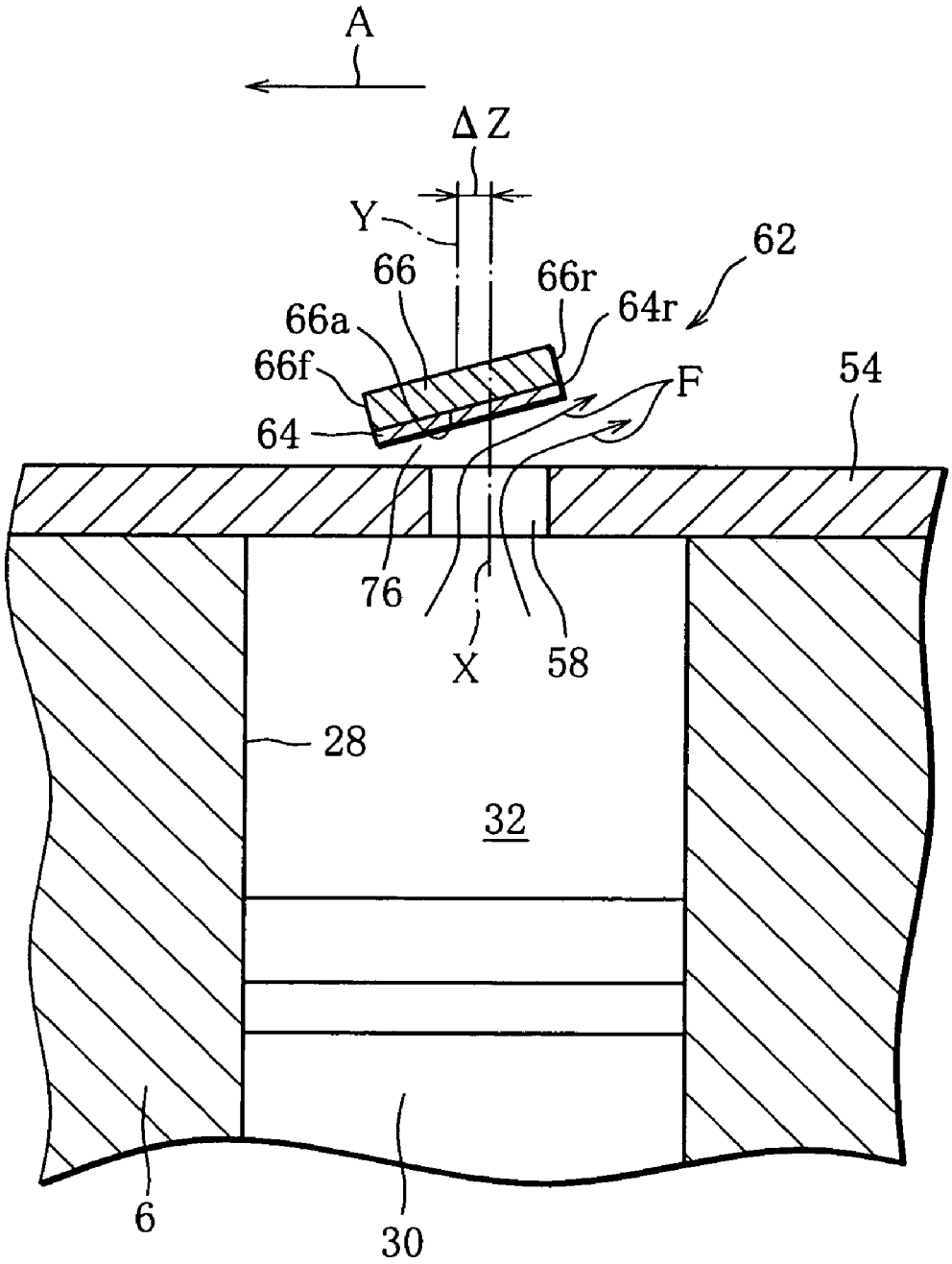
FIG. 3 is a sectional view taken along line III-III in FIG. 2.

As is clear from FIG. 3, each retainer 66 has a stopper surface 66*a* for regulating the lift of the corresponding valve reed 64. When viewed in cross section of the retainer 66, the stopper surface 66*a* is not parallel with the other surface 54*b* of the valve plate 54 but is inclined with respect to the other surface 54*b*. Specifically, the retainer 66 is twisted over an entire length thereof such that the rear side edge 66*r*, as viewed in the rotating direction of the swash plate 18 indicated at A in FIG. 3, is remoter from the valve plate 54 than the front side edge 66*f*.

Each discharge hole 58 and its corresponding discharge valve 62 cooperatively constitute a discharge valve device of the present invention. In the discharge valve device according to a first embodiment, the discharge hole 58 is circular in shape, as clearly shown in FIG. 2. The axis X of the discharge hole 58 (the center of gravity of the cross section of the discharge hole 58) is shifted from the center Y of the valve reed 64 in the width direction thereof by a predetermined distance $\Delta Z$ toward the side edge 64*r* of the valve reed 64 corresponding to the side edge 66*r* of the retainer 66.

Accordingly, when the valve reed 64 lifts from the valve plate 54 to open the discharge hole 58 while being elastically deformed by the pressure of the compressed refrigerant in the compression chamber 32, the flow of the refrigerant discharged from the discharge hole 58 collides mainly against one side portion of the valve reed 64 between the center Y in the width direction of the valve reed 64 and the side edge 64*r*. Such discharge flow of the refrigerant positively applies twisting moment to the valve reed 64, thereby assisting the twisting of the valve reed 64. As a result, the valve reed 64 is reliably twisted about the axis thereof (containing the center Y in the width direction), as shown in FIG. 3, so that the valve reed 64 comes into satisfactorily close contact with the stopper surface 66*a* of the retainer 66.

Consequently, the valve reed 64 never repeatedly strikes on the retainer 66 when lifted, thus preventing unpleasant noise from being produced by such vibrations of the valve reed 64. Also, since the valve reed 64 is sufficiently lifted, the refrigerant is smoothly discharged from the compression chamber 32, making it possible to prevent lowering of the compression efficiency of the compressor.

When the valve reed 64 is lifted, a flow path 76 is created between the valve reed 64 and the valve plate 54. The flow path 76 opens wider on the rear side as viewed in the rotating direction A of the swash plate 18. Accordingly, when the compressed refrigerant in the compression chamber 32 is discharged into the discharge chamber 40 through the discharge hole 58 and the flow path 76, the flow path 76 directs the discharge flow of the compressed refrigerant mainly in a direction opposite to the rotating direction A of the swash plate 18, as indicated by arrows F in FIG. 3. The discharge flow of the compressed refrigerant therefore exerts no adverse influence on the valve reed 64 of the discharge valve 62 to be opened next (i.e., the adjacent discharge valve 62 on the front side as viewed in the rotating direction A), thus ensuring stable opening of the individual discharge valves 62.

Figure 4:
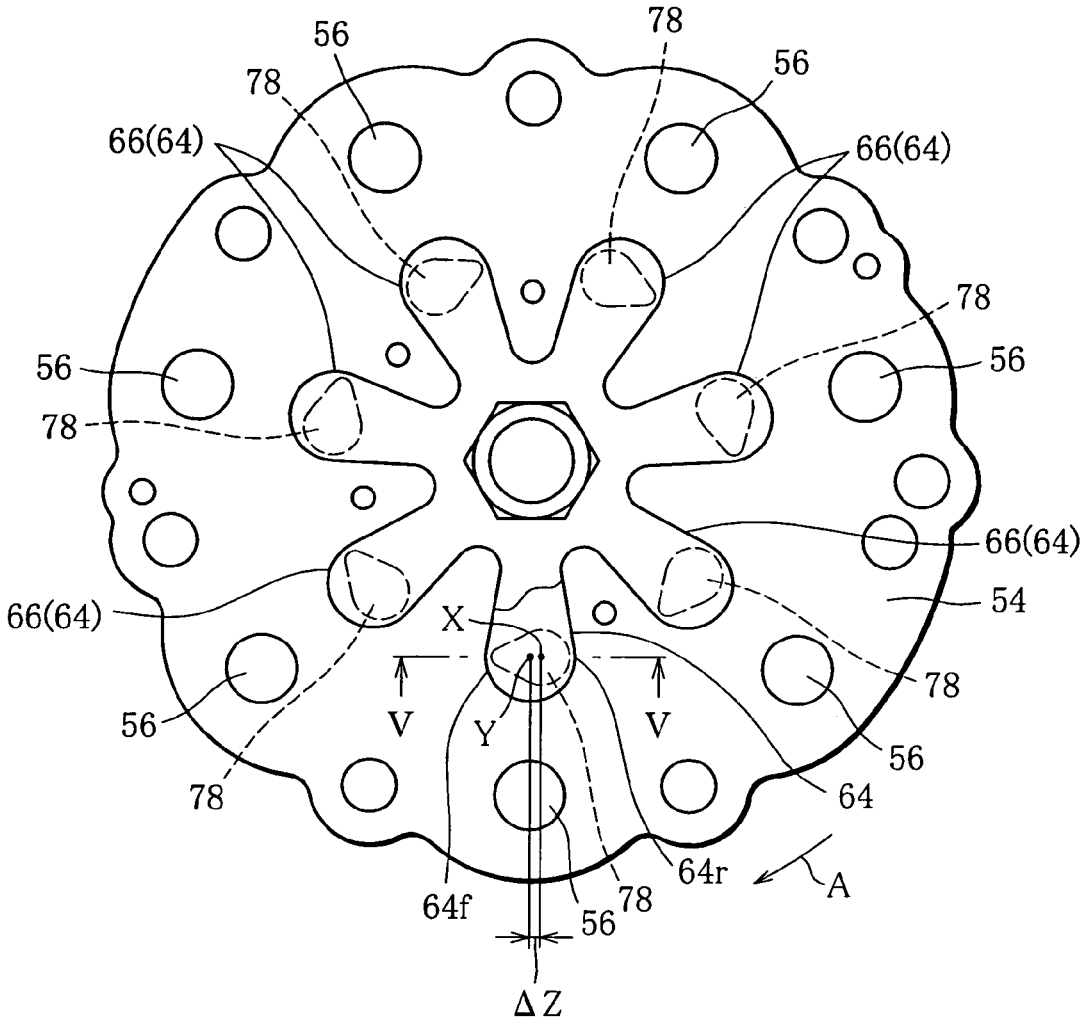
FIG. 4 is a rear view of discharge valve devices according to a second embodiment.
Figure 5:
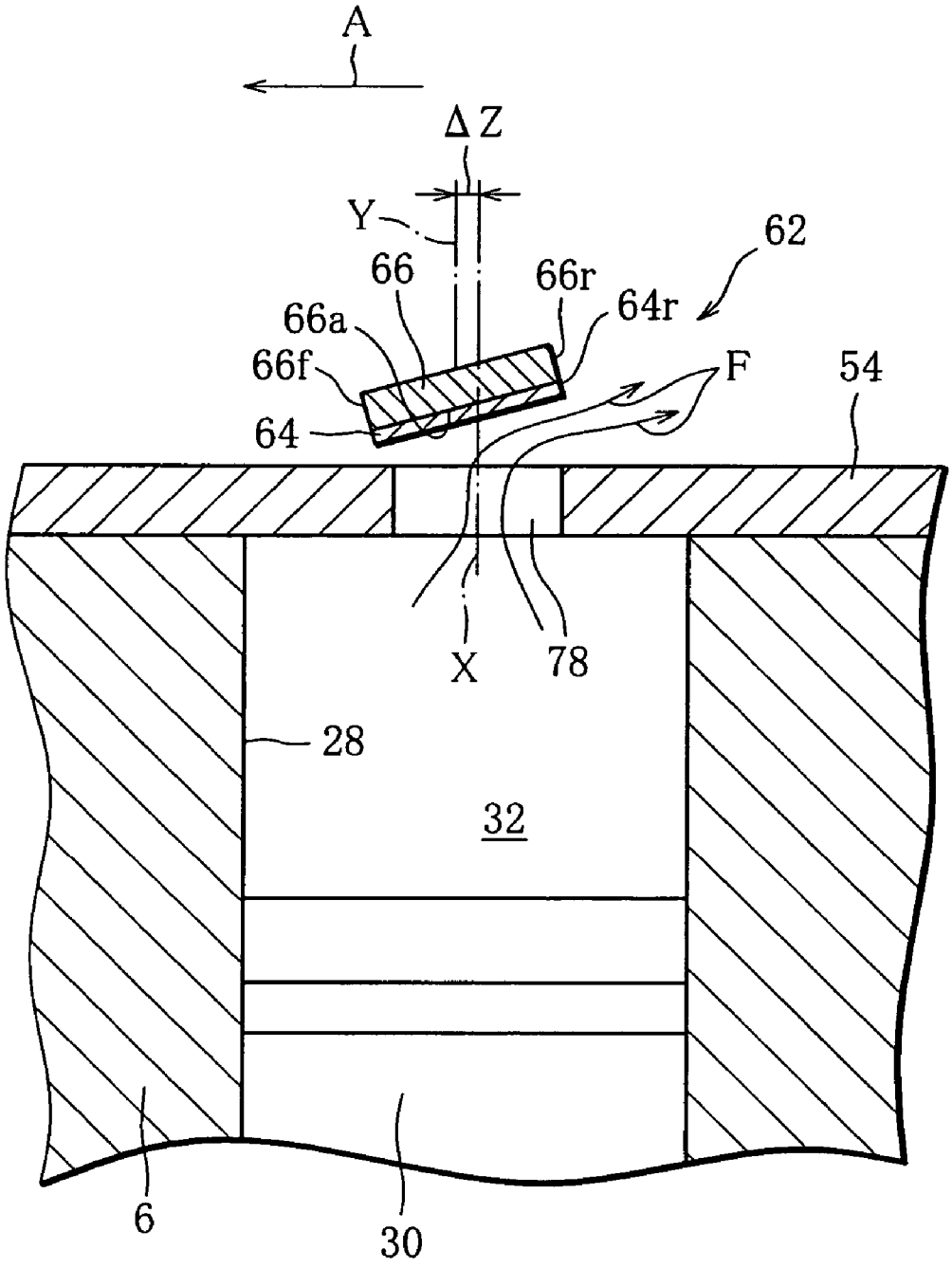
FIG. 5 is a sectional view taken along line V-V in FIG. 4.

FIGS. 4 and 5 illustrate discharge valve devices according to a second embodiment.

Each discharge valve device of the second embodiment has a discharge hole 78 with a pear-shaped cross section, in place of the discharge hole 58. More specifically, the cross section of the discharge hole 78 has a small-diameter end and a large-diameter end separated from each other in the width direction of the valve reed 64, and the large-diameter end is located on the same side as the side edge 64*r* of the valve reed 64. Like the discharge hole 58, therefore, the center X of gravity of the cross section of the discharge hole 78 is shifted from the center Y of the valve reed 64 in the width direction thereof by the predetermined distance $\Delta Z$ toward the side edge 64*r* of the valve reed 64.

Accordingly, when the valve reed 64 is lifted, the flow of the refrigerant discharged from the discharge hole 78 positively applies twisting moment to the valve reed 64 and thereby assists the twisting of the valve reed 64. As a result, the discharge valve device of the second embodiment can provide advantages similar to those achieved by the discharge valve device of the first embodiment.

Figure 6:
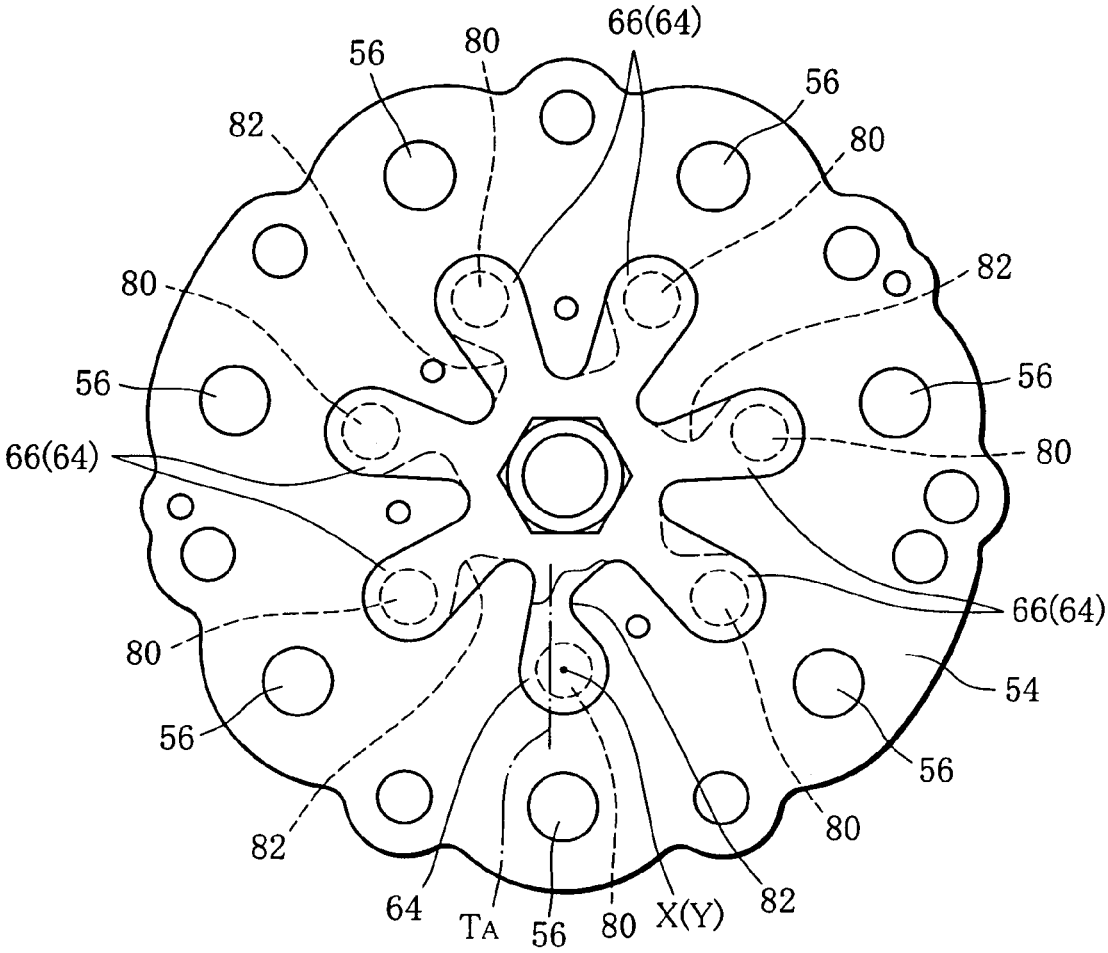
FIG. 6 is a rear view of discharge valve devices according to a third embodiment.

FIG. 6 illustrates discharge valve devices according to a third embodiment.

Each discharge valve device of the third embodiment has a circular discharge hole 80, like the discharge hole 58, but the axis X (center of gravity) of the discharge hole 80 and the center Y of the valve reed 64 in the width direction thereof are located in a common plane. In the third embodiment, therefore, the flow of the refrigerant discharged from the discharge hole 80 collides uniformly against the distal end portion of the valve reed 64.

However, in the third embodiment, the valve reed 64 has a bay portion 82 at the side edge 64*r* thereof. The bay portion 82 is located between the distal end portion and root of the valve reed 64 and decreases the width of the valve reed 64.

The bay portion 82 of the valve reed 64 serves to displace a twist axis $T_A$ of the valve reed 64 from the center Y in the width direction thereof toward the side edge 64*f*. Accordingly, the axis X of the discharge hole 80 is eventually shifted from the twist axis $T_A$ toward the side edge 64*r* of the valve reed 64, so that the flow of the refrigerant discharged from the discharge hole 80 positively applies twisting moment to the valve reed 64 and assists the twisting of the valve reed 64.

As a result, the discharge valve device of the third embodiment also can provide advantages similar to those achieved by the first and second embodiments.

Also, since the bay portion 82 serves to reduce the rigidity of the valve reed 64 against twisting, the valve reed 64 can be easily twisted about the twist axis $T_A$.

Figure 7:
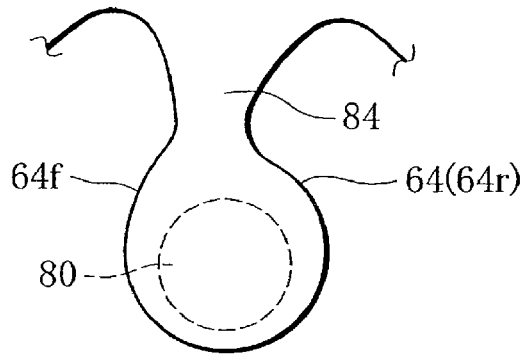
FIGS. 7 to 9 respectively show modifications of the discharge valve device shown in FIG. 6.
Figure 8:
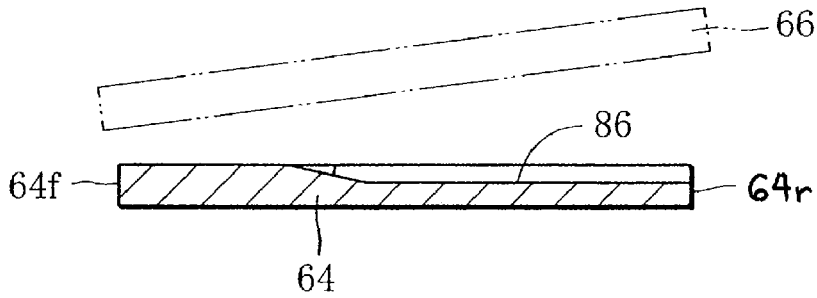
Figure 9:
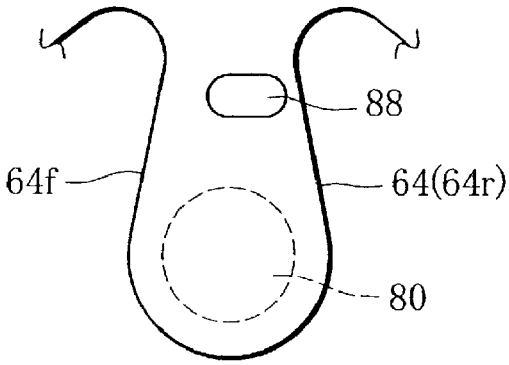

In the discharge valve device of the third embodiment, the valve reed 64 may alternatively have, instead of the bay portion 82, a neck portion 84 shown in FIG. 7, a thin portion 86 shown in FIG. 8, or an opening 88 shown in FIG. 9.

The neck portion 84, the thin portion 86 and the opening 88 all serve to reduce the rigidity of the valve reed 64 against twisting. Accordingly, when the valve reed 64 lifts and strikes against the stopper surface 66*a* of the retainer 66, the valve reed 64 is easily twisted in conformity with the inclination of the stopper surface 66*a* while being assisted by the portion 84, 86 or 88.

As a result, discharge valve devices having the valve reeds 64 of FIGS. 7 to 9 also can provide advantages similar to those achieved by the foregoing embodiments.

The neck portion 84 shown in FIG. 7 is preferably displaced from the center of the distal end portion of the valve reed 64 toward the side edge 64*f*. Also, the thin portion 86 shown in FIG. 8 and the opening 88 shown in FIG. 9 are each preferably displaced from the center of the distal end portion of the valve reed 64 toward the side edge 64*r*. In this case, the valve reeds 64 of FIGS. 7 to 9 each have the twist axis displaced from the axis of the discharge hole 80 toward the side edge 64*f*.

Figure 10:
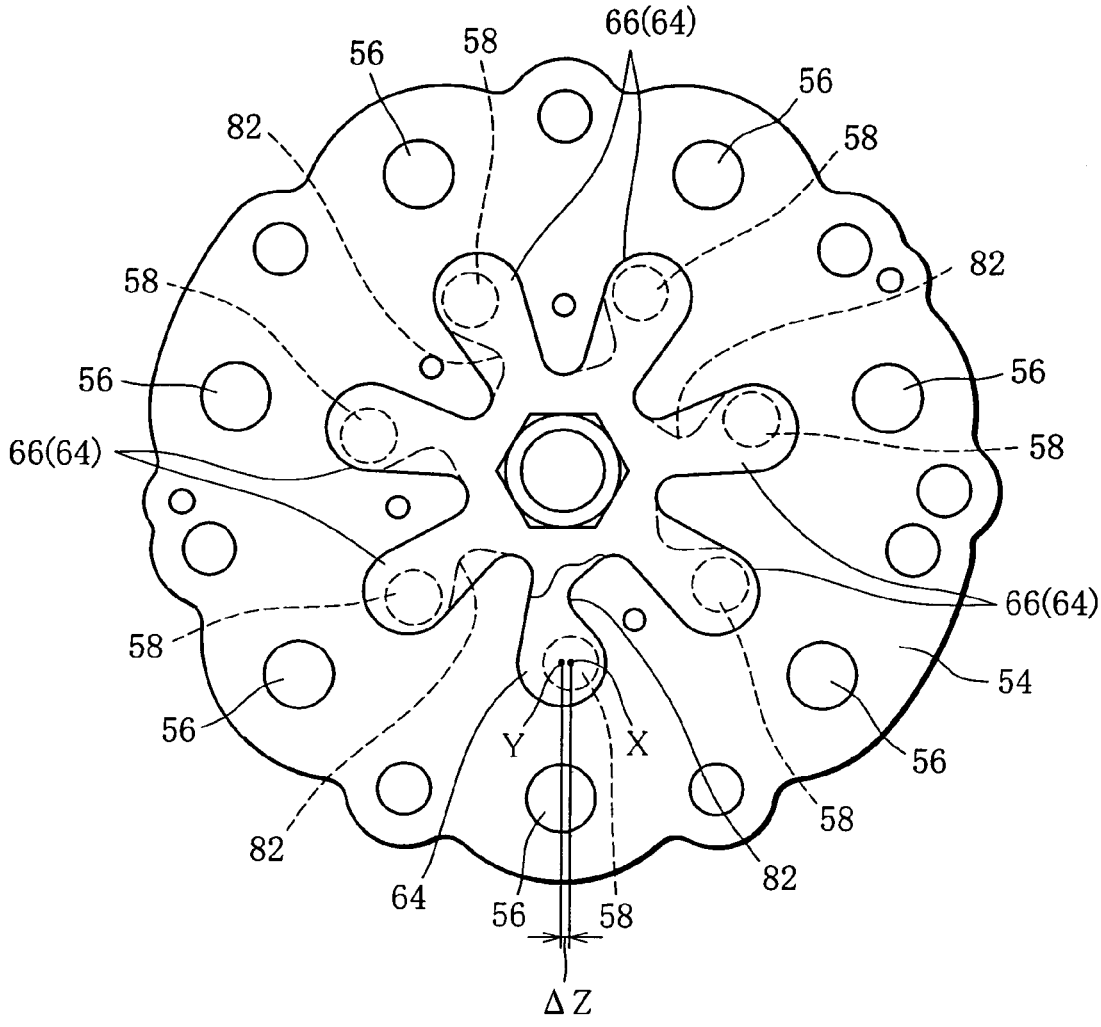
FIG. 10 is a rear view of discharge valve devices according to a fourth embodiment.

FIG. 10 illustrates discharge valve devices according to a fourth embodiment.

Each discharge valve device of the fourth embodiment has the discharge hole 58 (FIG. 2) of the first embodiment and the bay portion 82 (FIG. 6) of the third embodiment.

Figure 11:
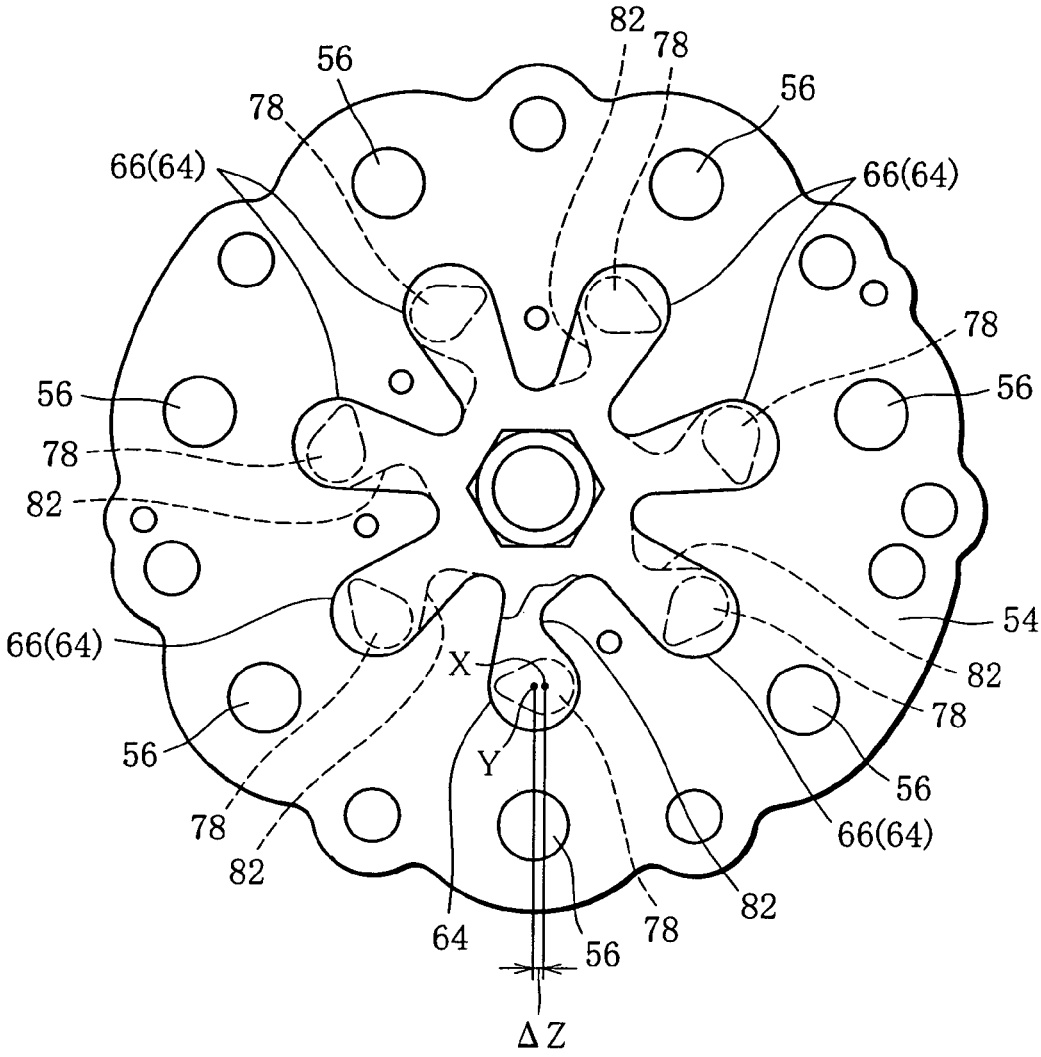
FIG. 11 is a rear view of discharge valve devices according to a fifth embodiment.

FIG. 11 illustrates discharge valve devices according to a fifth embodiment.

Each discharge valve device of the fifth embodiment has the discharge hole 78 (FIG. 4) of the second embodiment and the bay portion 82 (FIG. 6) of the third embodiment.

The discharge valve device of the fourth embodiment has the advantages of both the first and third embodiments, and the discharge valve device of the fifth embodiment has the advantages of both the second and third embodiments.

Figure 12:
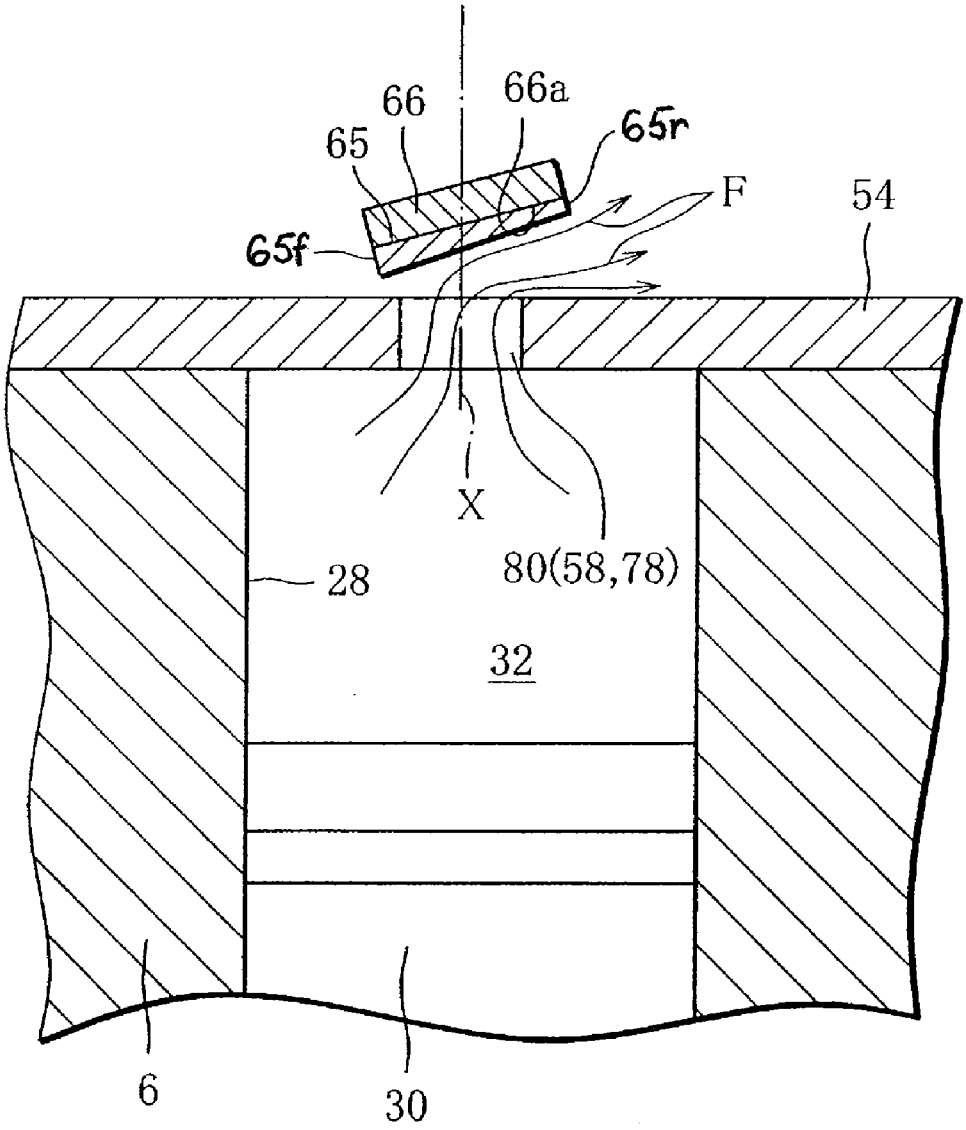
FIG. 12 is a sectional view of a discharge valve device according to a sixth embodiment.

FIG. 12 illustrates a discharge valve device according to a sixth embodiment.

The device of the sixth embodiment has the discharge hole 80 (FIG. 6) of the third embodiment and a valve reed 65. The thickness of the valve reed 65 gradually increases from the side edge 65*r* toward the side edge 65*f*. In this case, the twist axis of the valve reed 65 is displaced from the axis X of the discharge hole 80 toward the side edge 64*f* of the valve reed 65. When the valve reed 65 is lifted, therefore, the twisting of the valve reed 65 is assisted.

Consequently, the discharge valve device of the sixth embodiment also can provide advantages similar to those achieved by the foregoing embodiments.

The device of the sixth embodiment may alternatively have the discharge hole 58 or 78 of the first or second embodiment, in place of the discharge hole 80.

In the embodiments described above, the present invention is applied to a swash plate compressor, but can equally be applied to various other types of reciprocating compressors.

What is claimed is:

1. A multi-cylinder reciprocating compressor comprising:

a cylinder block having a plurality of cylinder bores;

pistons fitted into the respective cylinder bores and each forming one end wall of a compression chamber inside a corresponding one of the cylinder bores;

a driving device for reciprocating the pistons in the respective cylinder bores; and a valve mechanism for causing a suction process for sucking a working fluid into the compression chambers, a compression process for compressing the working fluid in the compression chambers and a discharge process for discharging the working fluid from the compression chambers to take place as the respective pistons reciprocate, said valve mechanism including a valve plate arranged adjacent to said cylinder block and forming other end walls of the respective compression chambers, said valve plate having a plurality of suction holes disposed for communication with the respective compression chambers, a plurality of suction valves associated with the respective compression chambers and permitting the working fluid to be sucked into the respective compression chambers through the respective suction holes, and a plurality of discharge valve devices associated with the respective compression chambers and permitting the working fluid to be discharged from the respective compression chambers, each of said discharge valve devices including a discharge hole formed through the valve plate in communication with a corresponding one of the compression chambers, an elastically deformable valve reed for closing the discharge hole during the suction process, said valve reed being lifted from the valve plate during the discharge process to open the discharge hole, a retainer disposed on the valve plate with the valve reed therebetween for regulating the lift of the valve reed, said retainer including a stopper surface extending along the valve reed for stopping the valve reed when the valve reed is lifted, said stopper surface being inclined with respect to the valve plate, as viewed in cross section of the retainer, and having a first side edge and a second side edge remoter from the valve plate than the one side edge, and assisting means for positively assisting the valve reed to be twisted in conformity with the inclination of the stopper surface when the valve reed is lifted.

2. The compressor according to claim 1, wherein said assisting means is materialized by shifting a center of gravity of a cross section of the discharge hole from a center of the valve reed in a width direction thereof toward the second side edge of the stopper surface.

3. The compressor according to claim 2, wherein said discharge hole has a circular cross section.

4. The compressor according to claim 2, wherein said discharge hole has a pear-shaped cross section.

5. The compressor according to claim 1, wherein said assisting means is materialized by shifting a twist axis of the valve reed from a center of gravity of a cross section of the discharge hole toward the first side edge of the stopper surface.

6. The compressor according to claim 5, wherein said valve reed has a bay portion formed at a side edge thereof close to the second side edge of the stopper surface, said bay portion being located between a root and distal end of the valve reed.

7. The compressor according to claim 6, wherein the center of gravity of the cross section of the discharge hole coincides with a center of the distal end of the valve reed in a width direction thereof.

8. The compressor according to claim 6, wherein the center of gravity of the cross section of the discharge hole is shifted from a center of the distal end of the valve reed in a width direction thereof toward the second side edge of the stopper surface.

9. The compressor according to claim 8, wherein said discharge hole has a circular cross section.

10. The compressor according to claim 8, wherein said discharge hole has a pear-shaped cross section.

11. The compressor according to claim 5, wherein said valve reed has a thickness decreasing from the one side edge of the stopper surface toward the other side edge of same.

12. The compressor according to claim 11, wherein the center of gravity of the cross section of the discharge hole is shifted from a center of a distal end of the valve reed in a width direction thereof toward the second side edge of the stopper surface.

13. The compressor according to claim 12, wherein said discharge hole has a circular cross section.

14. The compressor according to claim 12, wherein said discharge hole has a pear-shaped cross section.

15. The compressor according to claim 1, wherein said assisting means includes a flexible portion which is located between a distal end and root of the valve reed and at which a rigidity against twisting is less than that of a remainder of the valve reed.

16. The compressor according to claim 15, wherein said flexible portion comprises a neck portion where the valve reed is reduced in width.

17. The compressor according to claim 15, wherein said flexible portion comprises a thin portion where the valve reed is reduced in thickness.

18. The compressor according to claim 15, wherein said flexible portion comprises an opening for reducing a cross-sectional area of the valve reed.

19. The compressor according to claim 15, wherein a center of gravity of a cross section of the discharge hole is shifted from a center of a distal end of the valve reed in a width direction thereof toward the second side edge of the stopper surface.

* * * * *